United States Patent [19]

Wilson

[11] 4,247,745

[45] Jan. 27, 1981

[54] VACUUM-TYPE CONTACTOR ASSEMBLY

[75] Inventor: John R. Wilson, Darien, Ill.

[73] Assignee: Westinghouse Electric Corp., Pittsburgh, Pa.

[21] Appl. No.: 941,888

[22] Filed: Sep. 13, 1978

[51] Int. Cl.[3] ..... H01H 3/48; H01H 33/42

[52] U.S. Cl. ..... 200/144 B; 200/153 V; 200/DIG. 42

[58] Field of Search ..... 200/144 B, 144 R, 148 F, 200/153 V, 153 SC, 260, 244, DIG. 42, 337, 147 R, 144; 335/8, 11, 147, 195

[56] References Cited

U.S. PATENT DOCUMENTS

| | | | |
|---|---|---|---|
| 3,264,431 | 8/1966 | Hodgson | 337/7 |
| 3,264,432 | 8/1966 | Hodgson et al. | 337/7 |
| 3,264,433 | 8/1966 | Clark, Jr. et al. | 337/7 |
| 3,290,468 | 12/1966 | Clark, Jr. et al. | 337/211 |
| 3,582,587 | 6/1971 | Barkan | 200/144 B |
| 3,898,407 | 8/1975 | Hodgson | 200/144 B |
| 3,921,109 | 11/1975 | Hodgson | 200/147 R X |

*Primary Examiner*—James R. Scott
*Attorney, Agent, or Firm*—J. P. Johns

[57] ABSTRACT

A vacuum-type contactor assembly is provided having an operating linkage such that a fault, or heavy overload currents, will cause a maintenance of the contact-closed position, and a pair of springs are provided in the operating linkage, one of which is purely an atmospheric pressure compensating, or "kickoff", spring, whereas the other is a heavy contact pressure spring compressed following contact closure, and serving to provide both a hammer action at contact separation to break any welds occurring at the contact structure, and an accelerating force during contact opening.

Preferably, an electromagnetic actuating mechanism is utilized to effect the short travel and high contact forces typically required by vacuum-type switches.

2 Claims, 2 Drawing Figures

VACUUM-TYPE CONTACTOR ASSEMBLY

BACKGROUND OF THE INVENTION

Interrupting structures which have been utilized in conventional starter or contractor equipment, such as suitable for 400 amperes, 5 KV interrupting equipment, are well known in the art. Generally, such equipment is utilized in connection with fuse structures, and under certain (severe) conditions it is desirable to maintain the contactor contacts closed, so that the fuse equipment will fuse or "blow" first. It is usual in such starter equipment to provide a quick-opening and quick-closing with adequate contact pressure existing in the closed-circuit position of the equipment.

It is also desirable, in such starter equipment, to provide optional equipment which will enable the customer to specify either an air-break-type of interrupter or a vacuum-type interrupter. However, the latter type of equipment involves particular requirements, with which the present invention is concerned. U.S. Pat. No. 3,264,433 issued Aug. 2, 1966 to Russell D. Clark, Jr. and Charles J. Mahlar entitled "Switching Apparatus Employing Fuse As Movable Contacts and Having Safety Features" involves equipment related to the subject matter of the present invention. Also U.S. Pat. No. 3,264,431, issued Aug. 2, 1966, to Alfred W. Hodgson, entitled "Compact Switching Apparatus Employing Fuse As Movable Contacts", and assigned to the assignee of the instant invention relates to similar type equipment. Also U.S. Pat. No. 3,290,468, issued Dec. 6, 1966 to Russell D. Clark, Jr., and Charles J. Mahlar, entitled "Clip For Fuse Employed As Movable Member Switch" relates to the present equipment.

U.S. Pat. No. 3,264,431, issued Aug. 2, 1966 to Alfred W. Hodgson is concerned with the equipment of the type utilized in practicing the invention. Finally, reference may be had to U.S. Pat. No. 3,264,432, issued Aug. 2, 1966 to Alfred W. Hodgson and Russell D. Clark, Jr., as well as U.S. Pat. Nos. 3,898,407 and 3,921,109 to Alfred W. Hodgson, which related to similar-type equipment, all of the foregoing patents being assigned to the assignee of the instant invention, and all of the aforesaid patents relating to air-break equipment.

SUMMARY OF THE INVENTION

The present invention is concerned with the utilization of a vacuum-type circuit interrupter taken in conjunction with a suitable operating mechanism therefore, and applied, for example, to motor-starting equipment. Preferably fuse structures may be serially connected in the circuit to interrupt fault currents. The vacuum circuit interrupter, applied in the instant invention, has many advantages over air-break equipment, as utilized heretofore, inasmuch as there is no arcing occurring in air and the time required to interrupt current flow is much faster.

According to a preferred embodiment of the present invention, there is provided a vacuum-type circuit interrupter which has an operating linkage associated therewith utilizing a pair of operating springs, one of which is solely an atmospheric pressure compensating, or kick-out spring, whereas the other is a contact pressure spring, which is compressed only after the contacts make actual engagement.

The operating mechanism is actuated by an electromagnetic operating means, involving a magnet which provides the short stroke and high forces, that are normally required to operate high-power vacuum interrupter switches.

Moreover, the current-carrying parts are arranged in such a manner that they momentarily provide extremely high contact closing forces during short circuit or fault conditions.

The preferred embodiment has several adjusting means so that ready accessibility is provided for adjusting the contact stroke, and for additionally determining the amount of spring compression. The device is, for example, suitable on either 2.5 KV or 5 KV, 400 ampere motor starters controlling motors of up to 3000 HP and is completely interchangeable with the existing contactor assemblies used heretofore in connection with air-break circuit interrupters.

Accordingly, it is a general object of the present invention to provide an improved vacuum-type contactor assembly having an improved operating linkage therefor.

Another object is the provision of an improved highly-compact vacuum-type circuit interrupter in which springs are associated with the operating linkage to provide the desirable result of providing a hammer blow during the opening operation to break any welds associated with the contact structure and to provide, additionally, adequate contact pressure in the closed-circuit position.

Another object is the provision of an improved vacuum-type circuit interrupter motor starter equipment with the current-carrying parts so arranged that they will provide high transient contact closing forces during short-circuit or fault conditions.

Still a further object is the provision of visible and readily-accessible means for providing the adjustment associated with the vacuum-interrupter contact gap and overtravel.

An ancillary object is the provision of an improved vacuum-type contactor assembly, which is compactly arranged and suitable for ready adjustment while providing for quick-opening and quick-closing forces and providing linearly-directioned movement of various parts of the operating linkage.

DESCRIPTION OF THE PREFERRED EMBODIMENT

Figure 1:
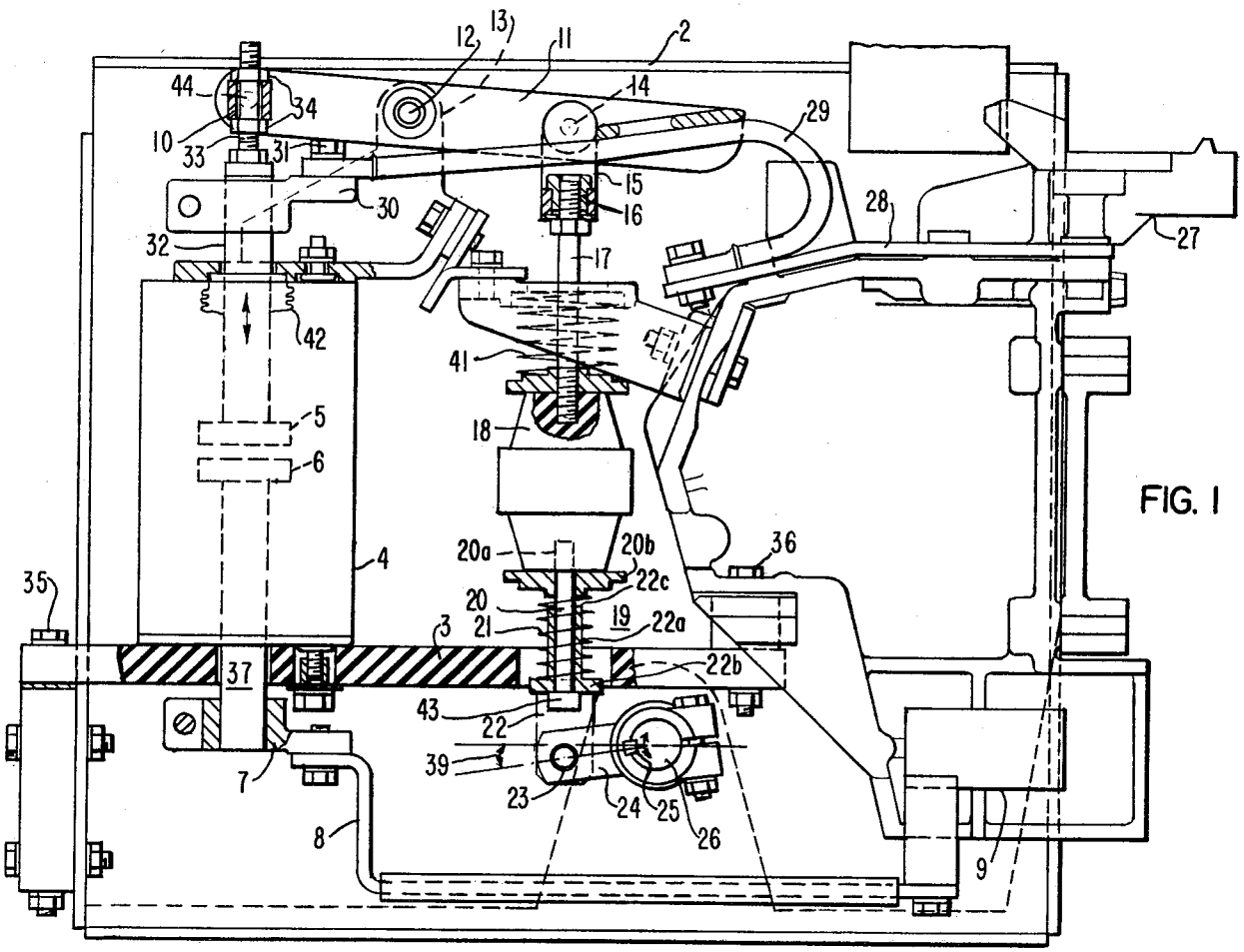
FIG. 1 is a side-elevational view, partially in vertical section, of the improved vacuum-type contactor assembly of the present invention, illustrated in the fully open-circuit position, and illustrating the pair of series springs employed with the operating mechanism.

In FIG. 1 a vacuum contactor assembly is generally indicated at 1, and it comprises a metallic frame 2 having an insulating base plate 3 associated therewith. Supported on the insulating base plate 3 is a vacuum interrupter 4 having a pair of separable contacts 5 and 6. The lower contact 6 is a stationary contact and extends downwardly through the insulating base plate 3 and has an electrical connection 7 secured thereto, which is connected through a line connector 8 to a load terminal assembly 9.

The movable contact 5 of the vacuum-type circuit interrupter 4 extends upwardly, and has an adjustable connection 10, to a pivotally-mounted operating lever 11. The operating lever 11 is stationarily pivotally mounted at 12 upon a lug portion 13 of the metallic frame and is actuated by a pivotal connection 14 to a furcation 15 which through the bight portion thereof, has an adjustable connection 16 to an operating stem 17, which is threadably secured to an insulator 18. The insulator 18 is connected to lost-motion coupling generally indicated at 19 which comprises a bolt 20, a coil spring 21, and an operating link 22. The upper ends of the bolt 20 is threadedly secured at 20*a* in the lower end of the insulator. An end plate or washer 20*b* abuts the insulator. The lower end of the bolt has a bolt head 43. The operating link 22 comprises a lower U-shaped portion and an upper tubular portion 22*a*. The U-shaped portion includes a bight part 22*b* which is disposed at the lower end of the tubular portion 22*a* and which protrudes into the path of travel of the bolt head 43. Likewise, the bolt head 43 protrudes into the path of travel of the tubular portion. Thus, the tubular portion and the bolt comprise a pair of members movable with respect to each other and with protrusions in their respective paths of travel.

Moreover, the tubular portion 22*a* is movably mounted on the shaft of the bolt 20 between extended and unextended conditions corresponding to the contact-open (FIG. 1) and contact-closed (FIG. 2) positions, respectively. In the position of FIG. 1 the coil spring 21, around the tubular portion, is extended between the end plate 20*b* and the bight part 22*b* to hold the bight part against the bolt head 43, whereby a gap 22*c* is disposed between the end plate 20*b* and the tubular portion 22*a*.

Figure 2:
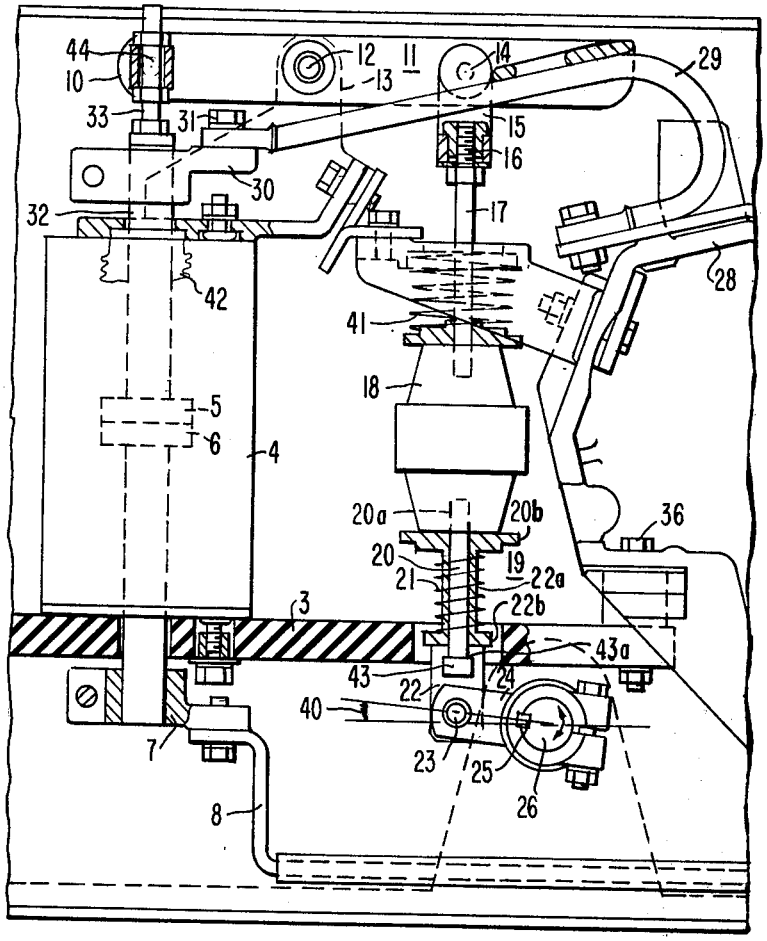
FIG. 2 is a view of the device of FIG. 1, but the operating linkage and contact structure being illustrated in the closed-circuit position.

In the position of FIG. 2 the operating link 22 is retained in an upper position by the crank arm 24 with the tubular portion 22*a* against the end plate 20*b*. Thus, the gap 22*c* (FIG. 1) is eliminated but a gap 43*a* is disposed between the bight part 22*b* and the bolt head 43. The coil spring 21 is contracted.

A U-shaped operating link 22 has the furcations, or legs, connected by a pivot bolt 23 to a crank arm 24, which is fixedly secured, as by a key 25, to the main operating shaft 26 of the vacuum contactor assembly. The operating shaft 26 is rotated in a clockwise direction during the closing operation of the contactor assembly by an electromagnet (not shown).

The line circuit through the vacuum contactor assembly 1 extends from a fuse terminal 27 through a conducting bar 28 to a U-shaped flexible shunt 29, which is electrically connected to a terminal 30 secured by a bolt 31 through a connector or movable contact carrier 32. As a result, during a fault, or heavy overload current, the electrical reaction is to effect higher contact-closing forces than is the case where no fault current exists.

The electromagnetic operating means (not shown), comprising the magnet, provides the short stroke and high forces normally required to operate high power vacuum interrupter switches. The current carrying parts of the vacuum contactor assembly 1 are also arranged in such a manner that they momentarily provide extremely high contact closing forces during short circuit or fault conditions. Visible and readily accessible means are also provided for adjusting the vacuum interrupter contact gap and overtravel, as provided by a threaded stud 33, which is adjustably secured in place by two lock nuts 34 which adjustably secure the threaded stud.

The vacuum contactor assembly 1 may be applied, for example, to a 400 ampere 5 KV vacuum contactor design which permits the use of vacuum interrupter switches within the conventional and existing-type contactor frame, normally used for air-break switches. It is completely interchangeable with the existing contactor assembly now utilized in the "Ampgard" starter so that vacuum interruption can optionally be offered commercially in an existing and well-accepted starter unit.

In FIG. 1 only one phase of a three-phase assembly is shown. The other two phases may be similarly mounted and have their own operating linkages which are individually pivotally connected to additional crank arms, which are keyed to the main operating shaft of the contactor assembly. The platform 3 of insulating material is bolted at 35, 36 within the steel frame to provide a rigid base for the vacuum switch. The switch is bolted to this space with its stationary contact stem 37 projecting through the platform 3, and connected through the connection 7 and conductor 8 to the contactor load terminal assembly 9. The upper end of the vacuum switch has its movable contact stem, or contact carrier 32, connected through the identical connector 30 to the flexible shunt 29 and conductor 28 to complete the power circuit to the contactor line or fuse terminal 27.

The operating mechanism linkage is physically parallel to the vacuum switch and is operated by a conventional electromagnet, which imparts a torque to the main drive shaft 26 in a conventional manner. The crank arm 24 on the shaft 26, has its angular travel equally divided about a horizontal centerline 38 of the shaft, as indicated by angles 39 (FIG. 1) and 40 (FIG. 2). The end of this arm 24 is pivotally connected to the operating lever 11, through a system of springs 21 and 41, and the insulator 18 to provide line-to-ground insulation. The lever 11 rotates around the fixed pivot 12 to transmit opening and closing forces to the moving contact stem or carrier 32.

OPERATION

Upon energizing an electromagnet, a torque transmitted to the main operating shaft 26 rotates the lever 24 in a clockwise direction (FIG. 2). As the crank arm moves upwardly, the "kickout" spring 41 is compressed, and the whole system moves upwardly as a unit and rocks the operating lever 11 about stationary pivot 12 to close the vacuum switch contacts. During this stage of the closing operation the contact spring 21 being much stiffer than the spring 41 does not deflect at this stage of the closing operation. The locus of pivot 26 is along a short arc equally divided about the horizontal centerline. The radius of the arc is such that the locus of the pivot is very nearly a straight line. The actual few thousandths of an inch of "wipe" is not enough to be detrimental to the mechanical life of the metallic bellows within the vacuum device, but is enough to be beneficial in breaking welds at the contact surface, should they occur.

Contact movement and deflection of spring 41 continues until the contacts touch. At this point, the whole system stops, except for contact spring 21, which now starts to compress as the tubular portion 20*a* slides upwardly along and is guided by bolt 20. Compression spring 21 continues to deflect until the electromagnet seals in. The vacuum switch contacts 5, 6 are held closed by a force, which is the result of three forces acting upon them, comprising the force due to atmospheric pressure acting upon a vacuum switch bellows 42, the force due to contact spring 21, minus the force due to kickoff spring 41. The spring 41 deflects only to the point of contact touch, and does not deflect during the working stroke of spring 21. Any gap (FIG. 2) between the tubular portion 20*a* and bolt head 43 indicates the spring deflection and also the contact overtravel.

During the opening operation, upon de-energizing the electromagnet, the contact spring 21 "unloads" and imparts a hammer blow to bolt head 43, and then to the separable vacuum switch contacts 5, 6. The hammer blow helps to break any contact welding which may have occurred. The contacts 5, 6 now separate, as spring 41 unloads, and rotates the operating lever 11 to the fully open position (FIG. 1).

There are many advantages which are present in the vacuum contactor assembly 1, including first, the reverse-current loop, which due to the flexible shunt 29 is arranged with a loop in it so that fault currents result in a repulsive force at the loop. By judicious selection of the loop shape, and its constraints, the repulsive force provides a very high transient contact closing force at current levels beyond the normal switch rating, by forces acting upon the leaf end of lever 11. This delays contact opening, thereby giving the current-limiting fuses time to blow, and, additionally, helps to prevent the separable contacts from welding, or blowing open.

Secondly, various adjustment features exist, whereby the linkage with the insulator 18 and springs 21, 41 are readily adjusted, since the spring seats are made, for example, from hexagonal bar, which act as lock nuts. Contact overtravel adjustment at pivot 44 is up front, where it is most accessible, and is achieved by adjustment of the lock nuts 34.

Moreover, the operating mechanism is arranged to provide a hammer blow when the operating electromagnet is de-energized to help break any possible contact welds, which may have occurred.

Finally, the operating mechanism also provides the correct closing and opening velocity for the moving contact 5 without imposing undue strain upon the vacuum interrupter components. This is in contrast to a toggle mechanism that applies relatively high forces and very slow closing and opening operations.

Although the device of this invention has been illustrated in connection with a 400 ampere, 5 KV vacuum contactor design, it is applicable to devices of different current and voltage ratings. In addition, the provision of the reverse current loop in the connector assembly is applicable to other interrupting devices other than a vacuum circuit interrupter. In other words, should an air-break device be utilized in place of the vacuum "bottle", the forces generated during high-fault current conditions would come into play to additionally maintain the contacts closed of such an air-break device so as to give time for the fuses to blow, as described hereinbefore.

Although there has been illustrated in the described specific structures, it is to be clearly understood that the same was merely for the purpose of illustration, and that changes and modifications may readily be made therein by those skilled in the art without departing from the spirit and scope of the invention.

What is claimed is:

1. A contactor assembly comprising, in combination:

switch means including a pair of separable contacts at least one of which is movable;

power means for actuating the movable contact between open and closed positions;

mechanical linkage means between the power means and the movable contact and comprising a motion-transfer link;

the motion transfer link having a lost-motion coupling including a pair of members movable longitudinally in the direction of motion of the motion-transfer link and with respect to each other between extended and unextended positions;

one of the pair of members being connected at one end to the power means and the other of the members being connected at one end to the motion-transfer link;

each member having a protrusion extending in the path of travel of each other;

guide-support means for said link;

first biasing means between the guide-support means and said link for initiating opening of the contacts when the power means moves to a contact-open position;

second biasing means on the lost-motion coupling for retaining the coupling in the extended position to effect closing of the contacts;

the second biasing means being less resilient than the first biasing means and being operative to actuate the motion-transfer link to the extended position when the power means moves to a contact-open position, and the second biasing means being operable when the power means moves to the contact-open position to drive said members to their extended position to cause one protrusion to impart a hammer blow to the other protrusion to thereby break any welding between the contacts.

2. The contactor assembly of claim 1 in which the pair of movable members are telescopically disposed with the second biasing means being a coil spring around the assembly of the members.

* * * * *